US008821359B1

(12) United States Patent
Kassel

(10) Patent No.: US 8,821,359 B1
(45) Date of Patent: Sep. 2, 2014

(54) ANCHOR DEVICE

(75) Inventor: Blake Kassel, Boca Raton, FL (US)

(73) Assignee: Bodylastics International, Inc., Boca Raton, FL (US)

( * ) Notice: Subject to any disclaimer, the term of this patent is extended or adjusted under 35 U.S.C. 154(b) by 323 days.

(21) Appl. No.: 13/323,984

(22) Filed: Dec. 13, 2011

(51) Int. Cl.
*A63B 21/00* (2006.01)

(52) U.S. Cl.
USPC ..... 482/121; 482/126; 482/904

(58) Field of Classification Search
USPC ..... 482/121, 126, 904, 124
See application file for complete search history.

(56) References Cited

U.S. PATENT DOCUMENTS

| | | | | |
|---|---|---|---|---|
| 679,784 | A | 8/1901 | Ryan | |
| 680,556 | A | 8/1901 | Wieland | |
| 726,095 | A | 4/1903 | Nightingale | |
| 760,374 | A | 5/1904 | Belvoir | |
| 3,815,904 | A * | 6/1974 | Weiss et al. | 482/123 |
| 4,611,804 | A | 9/1986 | Addair | |
| 5,176,602 | A | 1/1993 | Roberts | |
| 5,468,205 | A | 11/1995 | McFall et al. | |
| 5,984,845 | A * | 11/1999 | Powers | 482/148 |
| 6,059,698 | A | 5/2000 | Mazor | |
| 6,322,483 | B1 | 11/2001 | Rotella | |
| 6,908,418 | B2 | 6/2005 | Saure | |
| 7,976,445 | B2 | 7/2011 | Lalaoua | |
| 2003/0158024 | A1 * | 8/2003 | Saure | 482/126 |
| 2004/0087420 | A1 * | 5/2004 | Montesquieux | 482/129 |
| 2010/0173759 | A1 | 7/2010 | Lalaoua | |

* cited by examiner

*Primary Examiner* — Jerome w Donnelly
(74) *Attorney, Agent, or Firm* — Caesar, Rivise, Bernstein, Cohen & Pokotilow, Ltd.

(57) ABSTRACT

An anchor device for elastic exercise bands mountable on a vertical support member (e.g., a door) and includes a vertically oriented strap member and a plurality of horizontal strap members attached to a front section of the vertically oriented strap member in vertically spaced relationship to each other. At least two, transversely spaced-apart loop members for receiving an elastic exercise band therethrough are attached to at least one of the plurality of horizontal strap members. At least two, transversely spaced-apart ring members are attached to at least one of the plurality of horizontal strap members for receiving one or more elastic exercise bands.

14 Claims, 11 Drawing Sheets

ANCHOR DEVICE

BACKGROUND OF THE INVENTION

1. Field of Invention

This invention relates generally to an anchor device and more specifically to a multi-functional anchor device designed for use with elastic exercise bands.

2. Description of Related Art

Resistance training is an extremely popular form of exercise, employing a variety of different devices. One very popular resistance training device employs stretchable tubes or bands having handles or other body securement means attached to one or both of the opposed ends thereof, either directly or through attachment straps, carabineers and the like.

In order to enhance the versatility of training with elastic bands a variety of different anchor devices have been disclosed in the prior art. These anchor devices have been designed to be attached to various supporting surfaces, such as vertical walls, doors, mattresses and the like. For example, note the anchor devices disclosed in the following patents and publications: U.S. Pat. No. 679,784 (Ryan), U.S. Pat. No. 680,556 (Wieland), U.S. Pat. No. 726,095 (Nightingale), U.S. Pat. No. 760,374 (Belvoir), U.S. Pat. No. 4,611,804 (Addair), U.S. Pat. No. 5,176,602 (Roberts), U.S. Pat. No. 5,468,205 (McFall et al.), U.S. Pat. No. 6,059,698 (Mazor), U.S. Pat. No. 6,322,483 (Rotella), U.S. Publication No. 2004/0087420 (Montesquieux), U.S. Pat. No. 6,908,418 (Sauré), U.S. Publication No. 2010/0173759 (Lalaoua) and U.S. Pat. No. 7,976,445 (Lalaoua).

The Montesquieux '420 publication, the Rotella U.S. Pat. No. 6,322,483 and the Sauré U.S. Pat. No. 6,908,418 disclose anchor devices attachable to doors for use with elastic bands but do not have the unique, patentably novel features included in applicant's anchor device.

The Montesquieux '420 publication discloses a wide variety of net-like structures that are designed to be attached to a door and intended to be utilized with elastic exercise members. The disclosed structures include different numbers of vertical straps and in some cases horizontal straps. Although Montesquieux discloses a device employing metal ring members forming part of horizontal straps (FIGS. 6 and 7), in order to carry out a wide variety of exercises the exercise bands often need to be tied to the anchor device at various different locations (see FIGS. 15-23). In applicant's opinion, the anchor device disclosed in Montesquieux does not have the desired reliability and versatility achieved by applicant's anchor device.

The Rotella '483 patent discloses an anchor device in the form of a vertical extending strap mounted to a door including a plurality of vertically spaced fabric loops 24 for receiving exercise bands at different vertical heights, depending upon the exercise to be carried out. An anchor device of the type disclosed in the Rotella '483 patent has limited capabilities; that is, it is not well designed for providing the desired degree of versatility in carrying out different exercises with elastic bands.

The Sauré '418 patent discloses a vertically extending, door mounted exercise support band similar to that disclosed in the Rotella '483 patent, but including a plurality of vertically spaced rings for receiving an elastic exercise band at different vertical heights. Again, as is discussed above in connection with the Rotella '483 patent, the anchor device disclosed in the Sauré '418 patent does not have the desired degree of versatility in carrying out different exercises with exercise bands.

In view of the anchor devices disclosed in the prior art, a need is believed to exist for more highly versatile and reliable anchor device for use in carrying out multiple exercises with elastic bands. It is to such a unique anchor device that the present invention is directed.

All references identified herein are incorporated by reference in their entireties.

SUMMARY OF THE INVENTION

An anchor device providing multiple attachment locations for elastic exercise bands is mountable on a vertical support member, such as a door or other vertical wall structure. The anchor device includes a vertically oriented strap member with cooperating attachment members adjacent the opposed ends thereof for attaching the strap about the vertical dimension of the vertical support member. At least one horizontal strap member and more preferably a plurality of horizontal strap members is (are) attached to a front section of the vertically oriented strap member. When a plurality of horizontal strap members is employed they are in vertically spaced relationship to each other. The one or more horizontal strap members include cooperating attachment members adjacent the opposed ends thereof for attaching each horizontal strap member about a transverse dimension of the vertical support member. A front section of at least one horizontal strap member includes first and second end sections extending transversely from opposite sides of the vertically oriented strap member. At least two, transversely spaced-apart loop members are attached to at least one horizontal strap member having said first and second end sections and these spaced-apart loop members are adapted to receive an elastic exercise band therethrough. One of the at least two transversely spaced-apart loop members is on the first end section and another of the at least two transversely spaced-apart loop members is on the second end section, whereby when an elastic exercise band extends through two spaced-apart loop members located on the first and second end sections, respectively, slack in the band is taken up by the section of the band bridging the two spaced-apart loop members through which the band extends. At least two, transversely spaced-apart ring members are attached to at least one horizontal strap member having said first and second ends, with one of the at least two transversely spaced-apart ring members being on the first end section and another of the at least two transversely spaced-apart ring members being on the second end section. Each of said ring members is adapted to have one or more elastic exercise bands attached thereto.

In a preferred embodiment of this invention, at least one horizontal strap member includes at least two, transversely spaced-apart ring members and at least two transversely spaced-apart loop members thereon.

Most preferably at least one horizontal strap member having said first and second ends includes at least two, transversely spaced-apart ring members and at least two transversely spaced-apart loop members thereon, one of said at least two, transversely spaced-apart ring and loop members being on the first end section of said at least one horizontal strap member and another of said at least two, transversely spaced-apart ring and loop members being on the second end section of said at least one horizontal strap member.

In a preferred embodiment of this invention, at least two transversely spaced-apart ring members are attached to one horizontal strap member and at least two transversely spaced-apart loop members are attached to a horizontal strap member different from said one horizontal strap member; preferably with two transversely spaced-apart ring members being on the first and second ends of the horizontal strap member to which they are attached and two transversely spaced-apart loop members being on the first and second ends of the horizontal strap member to which they are attached.

In a preferred anchor device of this invention at least two, transversely spaced-apart ring members and at least two transversely spaced-apart loop members are on each of a plurality of horizontal strap members; most preferably on all of said plurality of horizontal strap members.

Preferably, at least one ring member and at least one loop member on each of said plurality of horizontal strap members is on a first end section of each of said plurality of horizontal strap members and at least a second ring member and at least a second loop member on each of said plurality of horizontal strap members is on a second end section of each of said plurality of horizontal strap members. Most preferably, the above arrangement of ring members and loop members is included on all of said plurality of horizontal strap members.

In a preferred embodiment the anchor device includes a central loop member having opposed end segments attached to a vertically oriented strap member in vertically spaced-apart locations straddling a region in which a horizontal strap member including at least two, transversely spaced-apart loop members is attached to the vertically oriented strap member.

In a preferred embodiment the anchor device includes a plurality of central loop members, each having opposed end segments attached to a vertically oriented strap member in vertically spaced-apart locations straddling a region in which a respective horizontal strap member including at least two, transversely spaced-apart loop member is attached to the vertically oriented strap member.

In a preferred embodiment, loop members of the anchor device include an outer, strong, fabric member and an inner member attached to said fabric member and having a lower coefficient of friction than said fabric member to minimize wear of an elastic exercise band outer surface during an exercise in which said elastic band extends through one or more of said loop members. Most preferably the inner member is wider than the fabric member and extends beyond spaced-apart marginal edges of the fabric member.

In a preferred embodiment, loop members of the anchor device are attached to a horizontal strap member in a four layer, stitched construction, wherein three of said layers are overlying segments of each of said loop members and the fourth layer is a segment of the horizontal strap member about which the overlying segments of each of said loop members are positioned.

The anchor device of claim 1, wherein at least two, transversely spaced-apart loop members each include an outer fabric member having opposed end segments, each end section being attached to a strap member of the anchor device in spaced-apart locations through a four layer, stitched construction; two of the four layers being provided by each respective end segment and an overlying segment of a strap member and the other two of said four layers being provided by opposed segments of a folded, attachment fabric folded over an edge of overlying segments of each of the end segments with a corresponding segment of the strap member.

In a preferred embodiment of the anchor device, a lowermost horizontal strap member located at a lower end of the front section of the vertically oriented strap member includes at least two transversely spaced-apart loop members attached thereto, said loop members attached to the lowermost horizontal strap member extending outwardly from the lowermost horizontal strap member substantially perpendicular to a front surface of said lowermost horizontal strap member.

Preferably, a plurality of upper horizontal strap members are spaced vertically from each other and upwardly from a lowermost horizontal strap, and transversely spaced-apart loop members are attached to one or more of the plurality of upper horizontal strap members and extend vertically downwardly from the upper horizontal strap members to which said loop members are attached; transversely spaced-apart loop members being attached to the lowermost horizontal strap member and extending outwardly from said lowermost horizontal strap member substantially perpendicular to a front surface of said lowermost horizontal strap member. Preferably, cooperating attachment means of the vertically oriented strap member and of the horizontal strap members are color-coded to provide a visual indication of the attachment means that cooperate with each other and are intended to be connected together.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

Figure 1:
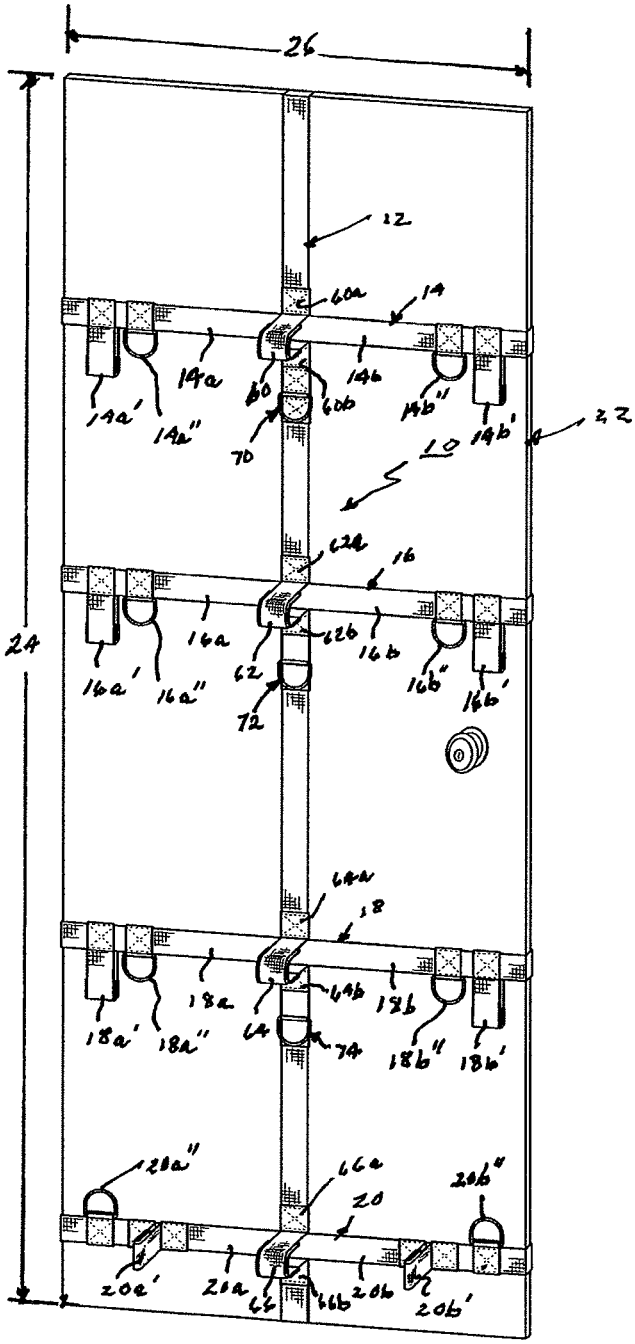
FIG. 1 is an isometric view showing the front of an anchor device of this invention, attached to a door.
Figure 2:
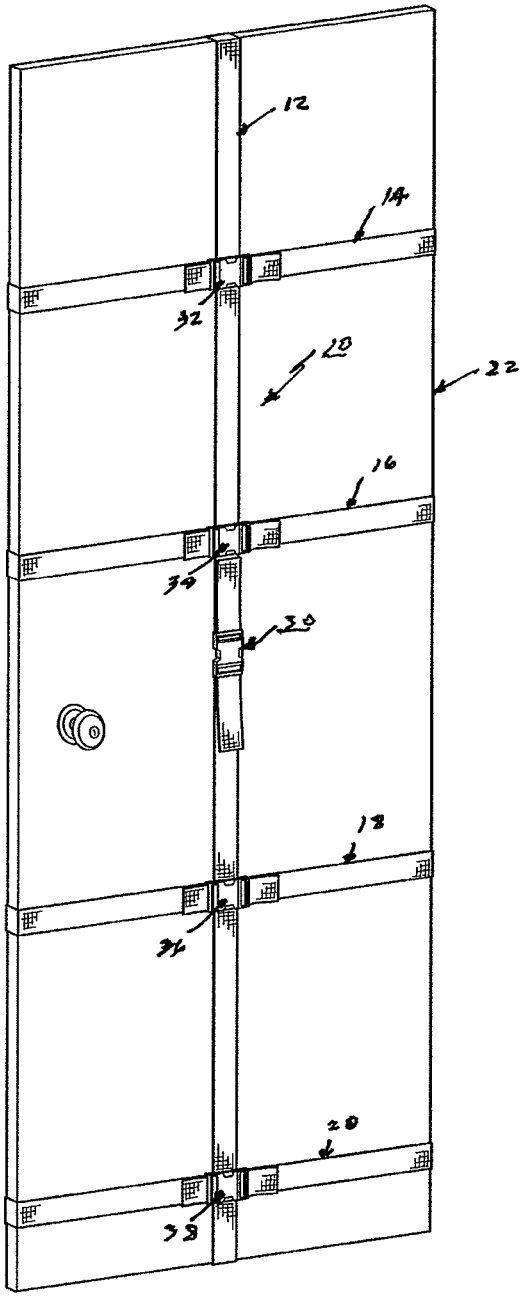
FIG. 2 is an isometric view showing the rear of the anchor device illustrated in FIG. 1, attached to a door.

Referring to FIGS. 1 and 2, an anchor device in accordance with this invention is illustrated generally at 10. This anchor device includes a vertically oriented strap member 12 and a plurality of horizontal strap members 14, 16, 18 and 20, mounted or connected to the vertically oriented strap member 12 in vertically spaced apart relationship to each other. It should be understood that the number of horizontal strap members employed in the anchor device is a matter of choice; however, in the preferred embodiment of this invention at least two such horizontal strap members are employed and most preferably four such horizontal strap members are employed. However, in accordance with the broadest aspects of this invention a single horizontal strap member can be employed; having the construction and arrangement of elements of any one of the horizontal strap members 14, 16, 18 and 20, to be described in detail later herein.

Reference throughout this application to a "plurality" of strap members means at least two strap members, unless specifically indicated otherwise.

Reference to various orientations, directions or positions in describing the anchor device of this invention, e.g., "vertically" or "vertical," "horizontally" or "horizontal", "transversely" or "transverse," "outwardly" or "outward," "lower or lowermost," "upper" or "uppermost," is with reference to the anchor device being attached to a vertical support member such as a door.

Still referring to FIGS. 1 and 2, the anchor device 10 is illustrated as being attached to a door 22, said door including a vertical dimension 24 and a transverse dimension 26. However, it should be understood that the anchor device could be employed with vertical support members other than doors.

Referring to FIG. 2, a buckle 30 is employed to connect ends of the vertically oriented strap member 12 together, and to permit the tightening of the strap member about the vertical dimension of the door. In addition, the anchor device includes buckles 32, 34, 36 and 38, each identical to buckle 30, for connecting together the ends of the horizontal strap members 14, 16, 18 and 20 respectively, about the transverse dimension 26 of the door 22. In this manner, both the vertically oriented strap member 12 and the horizontal strap members 14, 16, 18 and 20 can be tightened against the door to provide a strong and reliable anchor device for receiving elastic exercise bands as will be described in greater detail hereinafter. In the preferred embodiment, male and female connecting members of the buckles are color coded to clearly indicate the members that are to be connected together. For example, the male and female members of buckle 30 can be black; the male and female members of buckle 32 can be red, the male and female members of buckle 34 can be yellow, etc.

Figure 2A:
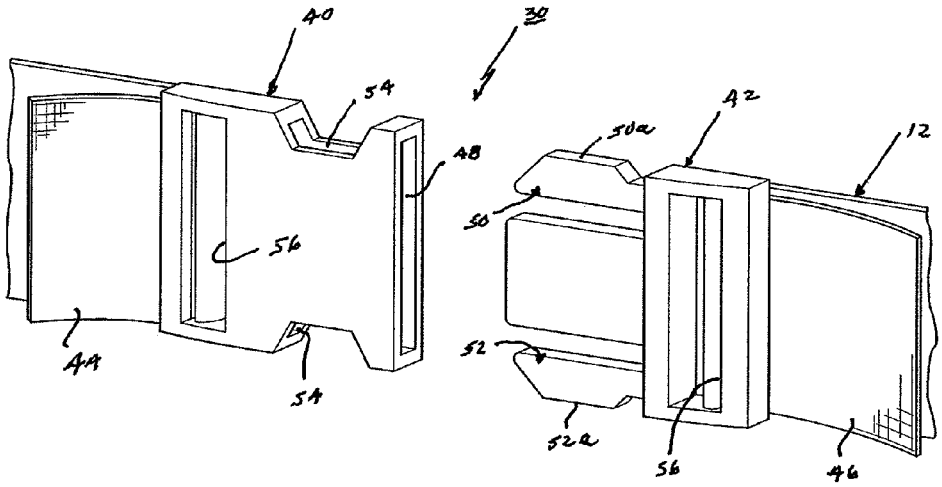
FIG. 2*a* is an enlarged, isometric view illustrating the buckle employed to attach together each of the strap members of the anchor device of this invention.

Referring to FIG. 2A, the construction of buckle 30 will be described; it being understood that in the preferred embodiment of this invention all of the buckles 30, 32, 34, 36 and 38 are of an identical construction. The buckle 30 includes cooperating female and male attachment members 40, 42, respectively, adjacent opposed free ends 44, 46 of the vertically oriented strap member 12.

The female attachment member 40 includes a central passage 48 for receiving flexible fingers 50, 52 of the male attachment member 42 therein. The flexible fingers 50, 52 include outwardly directed locking buttons or locking projections 50*a*, 52*a* for snapping into transverse passages 54 that communicate with the central passage 48 of the female attachment member 40 when the cooperating female and male attachment members 40, 42 are connected together.

Still referring to FIG. 2A, it should be noted that free ends 44, 46 of the strap member 12 are threaded about respective spindles (not shown) aligned with a transverse passage 56 located at the rear of the female and male attachment members 40, 42, respectively, to thereby permit attachment of the strap 12 to the female and male members and to permit the strap to be tightened about the door.

Referring to FIG. 1, which shows the front, or active section of the anchor device 10, each of the horizontal strap members 14, 16, 18 and 20 includes first and second end sections extending transversely outwardly from the vertically oriented strap member 12. Specifically, the horizontal strap member 14 includes first and second end sections 14*a*, 14*b* extending from opposite sides of the vertically oriented strap member 12. In a like manner, first and second end sections 16*a* and 16*b*, 18*a* and 18*b*, and 20*a* and 20*b* of the horizontal strap members 16, 18 and 20, respectively, also extend outwardly on opposite sides of the vertically oriented strap member 12.

Still referring to FIG. 1, in accordance with the broadest aspects of this invention, at least one of the horizontal strap members includes both a pair of loop members and a pair of ring members transversely spaced thereon. In the most preferred embodiment of this invention each end section of each of the horizontal strap members 14, 16, 18 and 20 includes both a loop member and a ring member thereon. Specifically, loop members 14*a*', 16*a*', 18*a*' and 20*a*' are attached to the first end sections 14*a*, 16*a*, 18*a* and 20*a*, respectively, by unique stitch constructions to be described in detail hereinafter. The unique stitched constructions employed to attach the loop members 14*a* 16*a* and 18*a*' to their respective horizontal strap members 14, 16 and 18 are identical to each other and different from the stitched construction employed to attach the loop member 20*a*' to its cooperation horizontal strap member 20, as will be described in detail hereinafter.

Still referring to FIG. 1, each of the loop members 14*b*', 16*b*', 18*b*' and 20*b*' are attached to the second end sections 14*b*, 16*b*, 18*b* and 20*b*, respectively, by unique stitched constructions to be described in detail hereinafter. The unique stitched constructions employed to attach the loop members 14*b*', 16*b*' and 18*b*' to their respective horizontal straps are identical to each other and different from the stitched construction employed to attach the loop member 20*b*' to its cooperating horizontal strap 20, as will be described in detail hereinafter. It should be noted that the stitched construction attaching loop members 20*a*' and 20*b*' to the horizontal strap member 20 is the same.

Still referring to FIG. 1, in the most preferred embodiment of this invention, each of the horizontal strap members 14, 16, 18 and 20 includes spaced apart ring members attached thereto. Specifically, in the preferred embodiment of this invention, ring members 14*a*", 16*a*", 18*a*" and 20*a*" are attached to the first end sections 14*a*, 16*a*, 18*a* and 20*a* of corresponding horizontal straps 14, 16, 18 and 20. In a similar manner, ring members 14*b*", 16*b*", 18*b*" and 20*b*" are attached to the second end sections 14*b*, 16*b*, 18*b* and 20*b* of respective horizontal strap members 14, 16, 18 and 20, respectively.

By positioning spaced apart loop members and ring members on at least one of the horizontal strap members 14, 16, 18 and 20 to cooperate with one or more elastic exercise bands, a number of different exercises can be carried out in a manner considered to be more reliable and efficient than with the use of a number of other prior art anchor devices.

Still referring to FIG. 1, the anchor device 10, in the preferred embodiment of this invention, includes additional loop members 60, 62, 64 and 66, which are each attached to the vertically oriented strap member 12 by the same unique stitched construction. Specifically, loop member 60 includes opposed end segments 60*a*, 60*b* that straddle horizontal strap member 14 and are provided with a unique stitched connection that will be described in detail hereinafter.

Similarly, loop member 62 includes opposed end segments 62*a*, 62*b* straddling horizontal strap member 16; loop member 64 includes opposed end segments 64*a*, 64*b* straddling horizontal strap member 18 and loop member 66 includes opposed end segments 66*a*, 66*b* straddling horizontal strap member 20.

In accordance with the broadest aspects of this invention additional loop members can be provided in other locations on the vertically oriented strap member 12, depending upon the degree of versatility desired or required in the anchor device 10.

Similarly, additional loop members can be provided on each of the horizontal strap members 14, 16, 18 and 20, again depending upon the degree of versatility that is desired or required in the anchor device 10.

Still referring to FIG. 1, a plurality of ring members 70, 72 and 74 also are attached to the vertically oriented strap member 12 in locations between horizontal strap members 14-16, 16-18 and 18-20, respectively. These ring members also are attached to the vertically oriented strap member by a unique stitched construction to be described in detail hereinafter.

Still referring to FIG. 1, it should be noted that the loop members 20*a*' and 20*b*' attached to the lowermost horizontal strap member 20 extend outwardly from the strap member substantially perpendicular to the front surface of said horizontal strap member. This is in distinction to the loop members attached to the first and second end sections of the other horizontal strap members 14, 16, 18, which all extend downwardly from these latter strap members.

In addition, it should be noted that the ring members 20*a*" and 20*b*" attached to the lowermost horizontal strap member 20 extend upwardly from that strap member. This is in distinction to the arrangement of the ring members on the first and second end sections of the horizontal strap members 14, 16 and 18, which all extend downwardly from their respective strap sections.

The loop members 20*a*', 20*b*' and the ring members 20*a*", 20*b*" are positioned on the lowermost horizontal strap member 20 as indicated above because of the close proximity of these loop members and ring members to the floor or other horizontal structure adjacent the lower end of the door or other vertical support member 22 to which the anchor device 10 is attached. Specifically, the orientation of the horizontal loop members 20*a*', 20*b*' substantially perpendicular to the horizontal strap member 20 prevents these latter loop members from engaging the floor, and provides desired clearance for permitting easy attachment of an elastic exercise band thereto to provide leg exercises or other exercises wherein a person is either sitting or kneeling on the floor or other horizontal structure.

Representative uses of elastic exercise bands in conjunction with the anchor device 10 of this invention will be described later in this application in connection with FIGS. 8 through 12.

Figure 3:
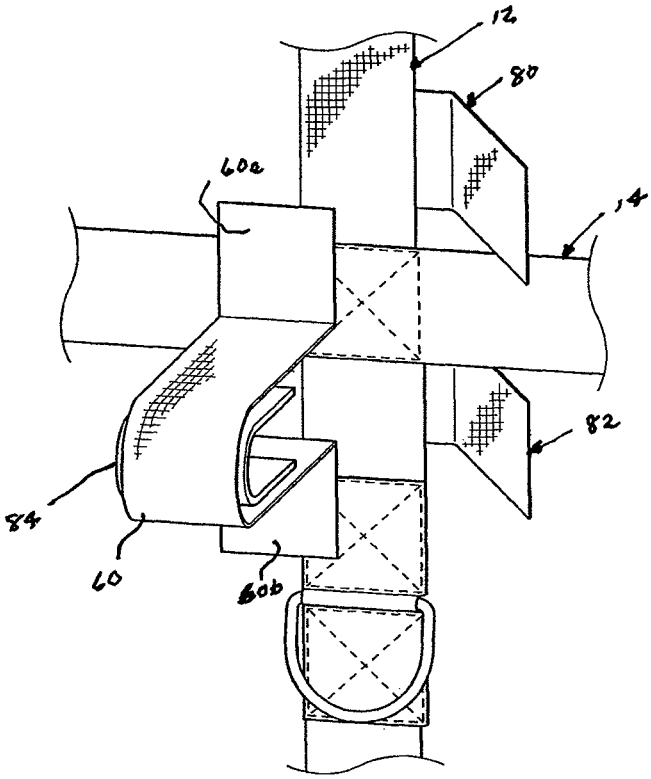
FIG. 3 is an exploded isometric view illustrating a unique construction for attaching loop members to a vertically oriented strap member in the anchor device of this invention.

Referring to FIG. 3, an exploded isometric view showing details of the loop member 60 and the manner in which the loop member is attached to the vertically oriented strap member 12 is illustrated. It should be understood that the unique stitched construction for securing the loop member 60 to the vertically oriented strap member 12 also is employed to secure the vertically oriented loop members 62, 64 and 66 to the vertically oriented strap member. Therefore, the unique stitched construction illustrated in FIG. 3 is included in the attachment of each of the vertically oriented loop members 60, 62, 64 and 66 to the vertically oriented strap member 12.

Still referring to FIG. 3, the loop member 60 includes end segments 60*a*-60*b* that are positioned in overlying, contiguous relationship with the vertically oriented strap member 12 on opposite sides of horizontal strap member 14. Attachment members 80, 82 are folded about the lower surface of the vertically oriented strap member 12 and the upper surfaces of end segments 60*a*, 60*b*, respectively. The folded attachment members 80, 82, after being folded over the vertically oriented strap member 12 and the corresponding end segments 60*a*, 60*b*, are then stitched together to provide a very strong, four-layer stitched construction. That is, the four-layer construction securing end segment 60*a* to the vertically oriented strap member 12 includes the two folded panels of the folded attachment member 80, the segment of the vertically oriented strap member 12 there between and the end segment 60*a* of the loop member 60. Similarly, a four-layer attachment construction is provided for the end segment 60*b* of the loop member 60.

As noted above, each of the loop members 60, 62, 64 and 66 are attached to the vertically oriented strap member 12 by the same construction as that illustrated in FIG. 3.

Still referring to FIG. 3, it should be noted that the loop member 60 is made of a strong, outer fabric from any suitable material, such as Nylon. The particular material employed in the fabric does not constitute a limitation on the broadest aspects of this invention. However, these strong fabric constructions generally provide a fairly rough inner surface that can damage or otherwise cause undesired wear of an elastic exercise band threaded through the loop member during the performance of an exercise. In order to prevent this excessive wear from occurring, the inner surface of the loop member is provided with an insert 84 made of a suitable low coefficient of friction material, such as Neoprene. In a preferred embodiment, the transverse dimension of the insert 84 is greater than the transverse dimension of the fabric of the loop member 60 and therefore extends transversely beyond each of the marginal ends of the fabric, on the order of approximately ⅛ inch to 3⁄16 inch. This arrangement in which the insert extends beyond the marginal edges of the outer fabric prevents the edges of the fabric of the loop member from engaging an elastic exercise band extending though the loop member and causing undesired wear of the surface of said elastic exercise band.

Preferably all of the loop members employed in the anchor device 10 of the present invention include the low coefficient of friction insert 84 therein to provide a structure that can be effectively employed with elastic exercise bands without causing undue wear or damage to those bands.

Figure 4:
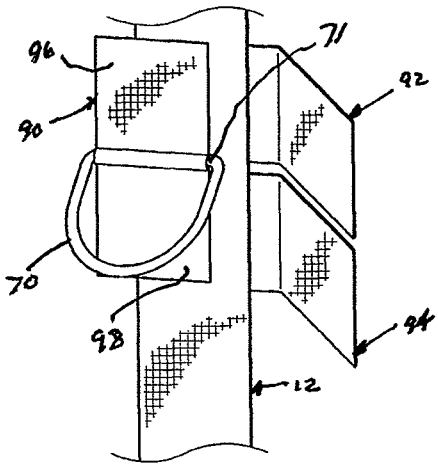
FIG. 4 is an exploded isometric view showing a unique arrangement for connecting a ring member to a vertically oriented strap member of the anchor device of this invention.

Referring to FIG. 4, the manner in which the ring member 70 is attached to the vertically oriented strap member 12 is shown. It should be understood that each of the other vertically oriented ring members 72 and 74 attached to the vertically oriented strap member 12 are attached in exactly the same way as the ring member 70. Therefore, the discussion which follows relating to the attachment of the ring member 70 to the vertically oriented strap member 12 applies to the additional vertically spaced apart ring members 72 and 74.

Still referring to FIG. 4, a substantially linear segment 71 of ring member 70 is sandwiched between a connecting fabric layer 90 and vertically oriented strap member 12, substantially midway along the length of the connecting layer 90. A pair of folded attachment members 92, 94, similar to the previously described folded members 80, 82, is folded about the vertically oriented strap member 12 and segments 96, 98 of the connecting layer 90 on opposed sides of the substantially linear segment 71 of the ring member 70. With the folded attachment members 92, 94 in overlying relationship with the vertically oriented strap member 12 and the segments 96, 98 of the connecting layer 90, suitable sewn stitching is provided to complete the stitched construction. Thus, it should be apparent that the stitched connection of the ring member 70 is provided by a very strong, four-layer system on each side of said ring member. Specifically, as is clearly shown in FIG. 4, the four layers providing the stitched connection on one side of the substantially linear segment 71 include the two panels of the folded attachment member 92, segment 96 of the connecting layer 90 and the segment of the vertically oriented strap member 12 underlying segment 96 of the connecting layer. This same four-layer construction is provided by the folded attachment member 94 in conjunction with end segment 98 of the connecting layer 90 and the segment of the vertically oriented strap member 12 underlying segment 98 of the connecting layer.

Figure 5:
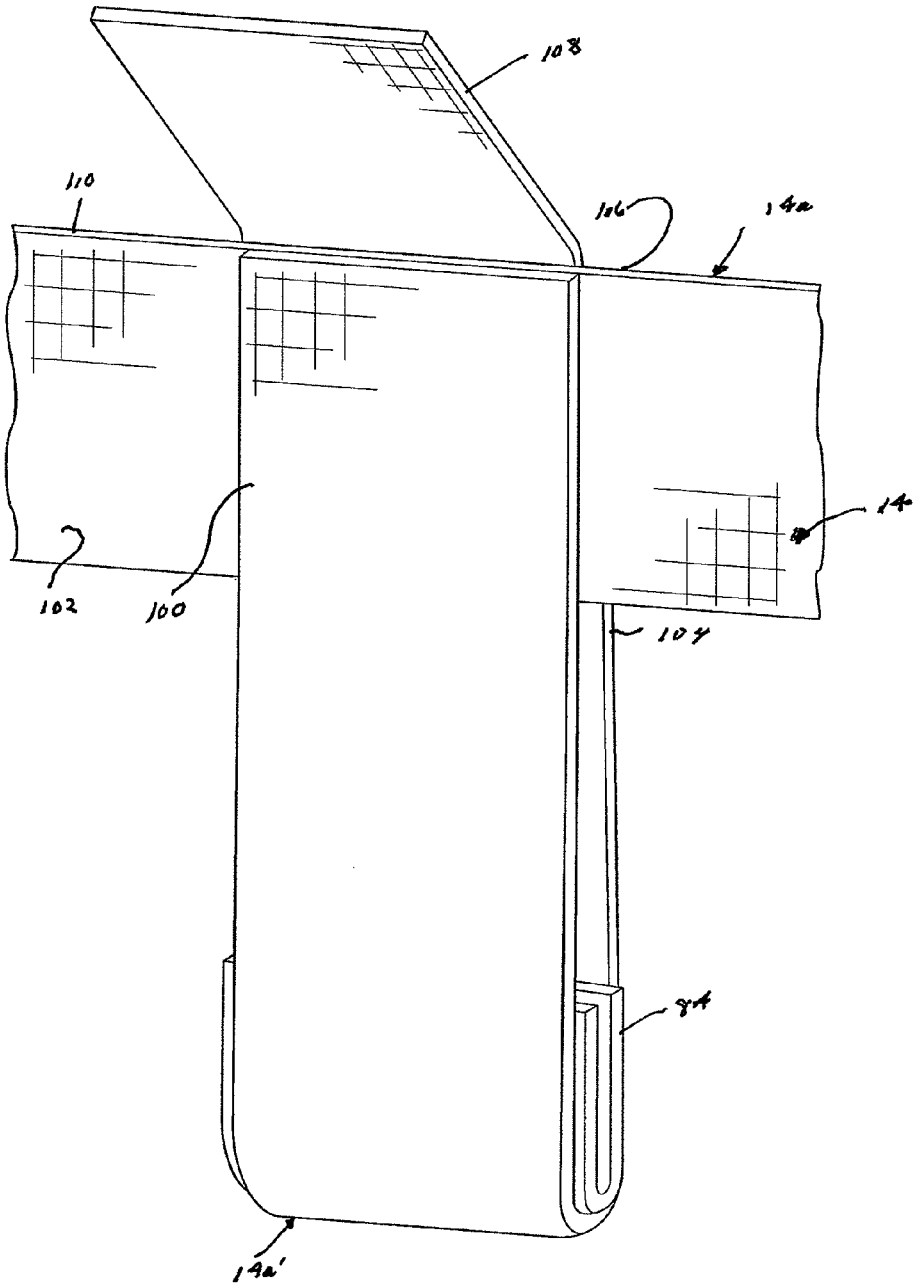
FIG. 5 is an isometric view illustrating a unique manner for connecting downwardly extending loop members to a horizontal strap member of an anchor device in accordance with this invention.

Referring to FIG. 5, the unique stitched construction employed to attach each of the downwardly extending loop members 14*a*', 16*a*', 18*a*', 14*b*', 16*b*' and 18*b*' to their respective end sections of the horizontal strap members 14, 16 and 18, is illustrated. Specifically, FIG. 5 illustrates the unique stitched construction employed to attach loop member 14*a*' to the first end section 14*a* of horizontal strap member 14, it being understood that all of the other of the above-identified loop members are attached to their respective horizontal strap members 14, 16 and 18 in the identical manner. Loop members 20*a*' and 20*b*' are attached to the first and second end sections 20*a*, 20*b*, respectively, of the horizontal strap member 20 in a different stitched construction, as will be described hereinafter.

Still referring to FIG. 5, the loop member 14*a*' includes a front segment 100 that overlays a front surface 102 of horizontal strap member 14, a rear segment 104 overlaying a rear surface 106 of the horizontal strap member 14 and a distal end segment 108 that wraps over an upper edge 110 of the horizontal strap member 14 and is positioned into overlaying, contacting relationship with the front segment 100 of the loop 14*a*'. In this arrangement the four layers provided by the front segment 100, the rear segment 104 and the distal end segment 108 of the loop member 14*a*'; in conjunction with the horizontal strap member 14 are all stitched together. This four-layer construction provides an extremely strong and reliable attachment of the loop members to their respective horizontal strap members to permit desired exercises to be carried out with elastic exercise bands attached thereto without damage or separation of the loop members from the anchor device 10.

It should be noted that the loop member 14*a* also includes a low coefficient of friction insert member 84, identical to that employed in all of the other loop members.

Figure 6:
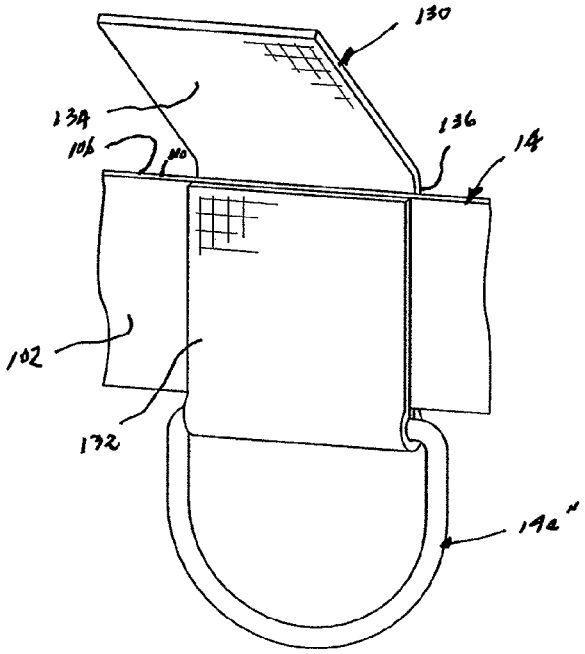
FIG. 6 is an isometric view illustrating a unique manner of connecting a ring member to a horizontal strap member in an anchor device of this invention.

Referring to FIG. 6, a unique stitched construction for attaching each of the ring members 14*a*", 16*a*", 18*a*" and 20*a*" to the first and second end sections of the horizontal strap members 14, 16, 18 and 20 is illustrated. Specifically, the description which follows relates to the attachment of the ring member 14*a*" to horizontal strap 14, it being understood that all of the other above-identified ring members attached to their corresponding horizontal strap members are attached in the same manner.

Still referring to FIG. 6, a foldable attachment fabric 130 includes outer end segments 132, 134 and an intermediate segment 136. One end segment 132 overlays and is in engagement with front surface 102 of horizontal strap member 14; the intermediate strap member 136 overlays and is in engagement with rear surface 106 of the horizontal strap member and the other outer segment 134 wraps over the outer edge 110 of the horizontal strap member into overlaying, contacting relationship with the outer segment 132 of the attachment fabric. The four overlaying layers created by the above construction are then stitched together to provide an extremely strong attachment of each of the ring members to their corresponding or respective horizontal strap members.

Figure 7:
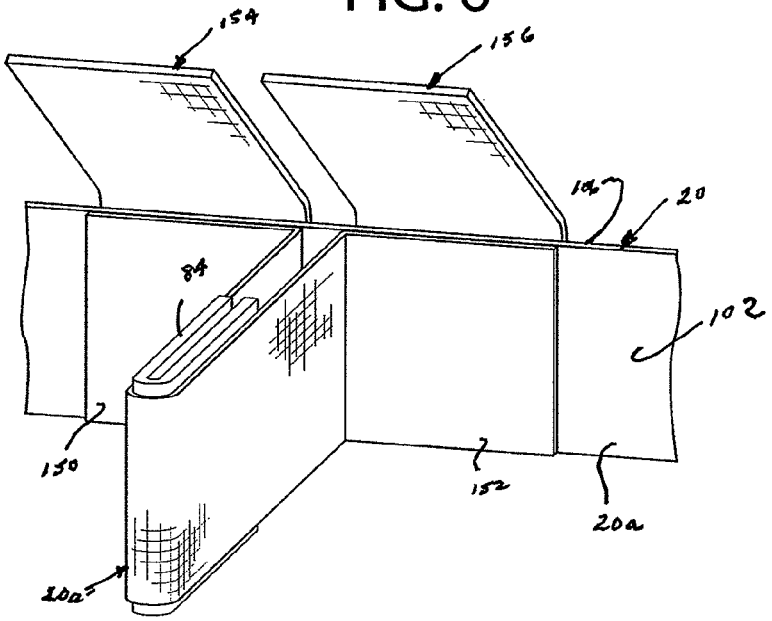
FIG. 7 is an isometric view illustrating a unique manner for connecting an outwardly directed loop member to a horizontal strap member in an anchor device of this invention.

Referring to FIG. 7, the manner in which loop members 20*a*' and 20*b*' are attached to their respective horizontal strap member 20 is illustrated. Specifically, the manner in which the loop members 20*a*' and 20*b*' are attached to their respective horizontal strap member 20 is very similar to the manner in which the vertically spaced apart loop members 60, 62, 64 and 66 are attached to their respective vertically oriented strap member 12.

Referring to FIG. 7, the manner in which horizontal loop member 20*a*' is attached to the first end section 20*a* of the horizontal fabric member 20 will be described, it being understood that the loop member 20*b*' is attached to the second end section 20*b* of the horizontal strap member 20 in exactly the same manner. Specifically, the horizontal loop member 20*a*' includes end segments 150, 152, each being in overlaying, contacting relationship with front surface 102 of the first end section 20*a* of the horizontal strap member 20. Folded attachment members 154, 156 are attached over the end segments 150, 152, respectively. Specifically, each of the members 154, 156 have two panels; one panel overlaying the rear surface 106 of the horizontal strap member 20 and the other panel in overlaying, contacting relationship with each of the end segments 150, 152, respectively of the horizontal loop member 20*a*'. As noted above, it should be understood that the loop member 20*b*', which also is attached to the horizontal strap member 20, is attached to that second end section 20*b* of the horizontal strap member in the same manner as the horizontal loop member 20*a* is attached to the first end section 20*a* of the horizontal strap member.

As can be clearly seen in FIGS. 1 and 7, the horizontal loop members 20*a*' and 20*b*' extend transversely away from the horizontal strap member 20 at right angles, or perpendicular, thereto. This provides sufficient clearance of the loop members 20', 20*b*' with the floor or other horizontal supporting surface to permit elastic exercise bands to be easily engaged with the loop members 20*a*', 20*b*' to carry out a variety of different exercises.

It should be understood that one or more elastic exercise bands can be employed with the anchor device 10 to provide a wide variety of exercises, generally limited only by the knowledge and imagination of the person engaged in or supervising an exercise routine. The specific construction of the exercise bands employed with the anchor device 10 of this invention does not constitute a limitation of the broadest aspects of this invention. By way of example only, the exercise bands can be of the type disclosed in Kassel U.S. Pat. No. 7,819,787; employing tethers and carabineers at opposed ends thereof. The subject matter of the Kassel '787 patent, which is assigned to Bodylastics International, Inc., the assignee of this application, is incorporated by reference herein.

Referring to FIGS. 8-12, exemplary exercises employing exercise bands and the anchor device 10 of this invention are illustrated, it being understood that the illustrated exercises are only representative of a much larger number of exercises that can be employed with the anchor device of this invention.

Figure 8:
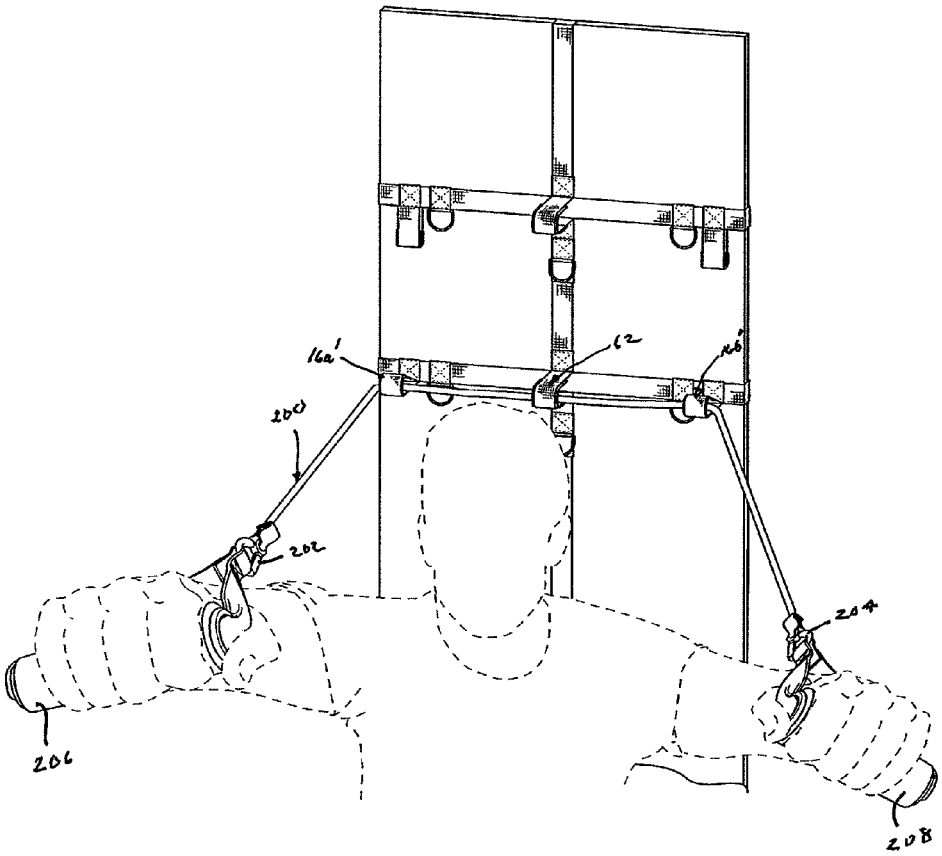
FIGS. 8 through 12 are isometric views illustrating exemplary ways of connecting exercise bands to the anchor device of this invention for the purpose of providing a number of different exercises to target various muscle groups.

Referring to FIG. 8, a single elastic exercise band 200 is positioned through horizontally spaced-apart and aligned loop members 16*a*', 62 and 16*b*', and the opposed ends of the band are connected by carabineers 202, 204 to suitable engagement means, such as handles 206, 208. It should be understood that the elastic exercise band 200 employed with the anchor device 10 of this invention can be any one of a number of different constructions, the specific construction of the exercise band not constituting a limitation on the broadest aspects of this invention.

As can be seen in FIG. 8, an individual can engage in the illustrated exercise with his/her back to the door and alternately or simultaneously extending his/her arms against the resistive force imposed by the elastic band. The illustrated exercise can be employed to strengthen or build up different areas of the chest, and in particular the peck muscles.

It should be understood that the elastic band 200 illustrated in FIG. 8 could alternately be extended through horizontally aligned loop members 14*a*', 60 and 14*b*', or alternatively through the horizontally aligned loops attached to horizontal strap members 18 or 20, to thereby change the angle in which the exercise is carried out or to permit other exercises to be carried out, e.g., curls, etc.

Figure 9:
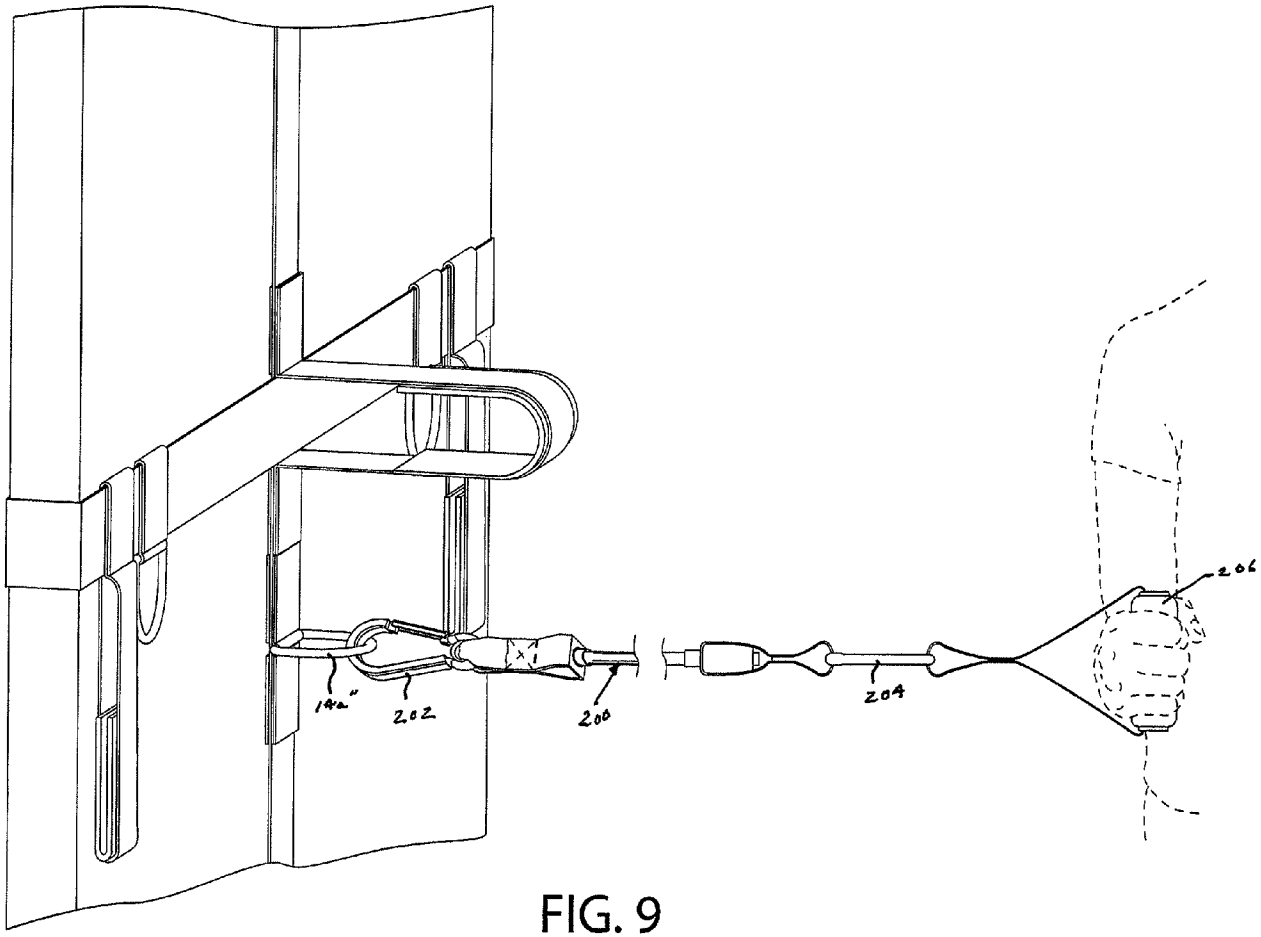

Referring to FIG. 9, exercise band 200 including carabineers 202, 204 at opposed ends are attached respectively to a ring member (e.g., 14*a*", 16*a*") at one end thereof and to a handle 206 at the opposite end thereof to provide a shoulder strengthening exercise. Specifically, this exercise is carried out by a user gripping the handle 206 in one hand and rotating his/her hand, with the elbow remaining essentially stationary and close to the body, to pull the exercise band across his/her body against the resistive force provided by the stretched band.

Figure 10:
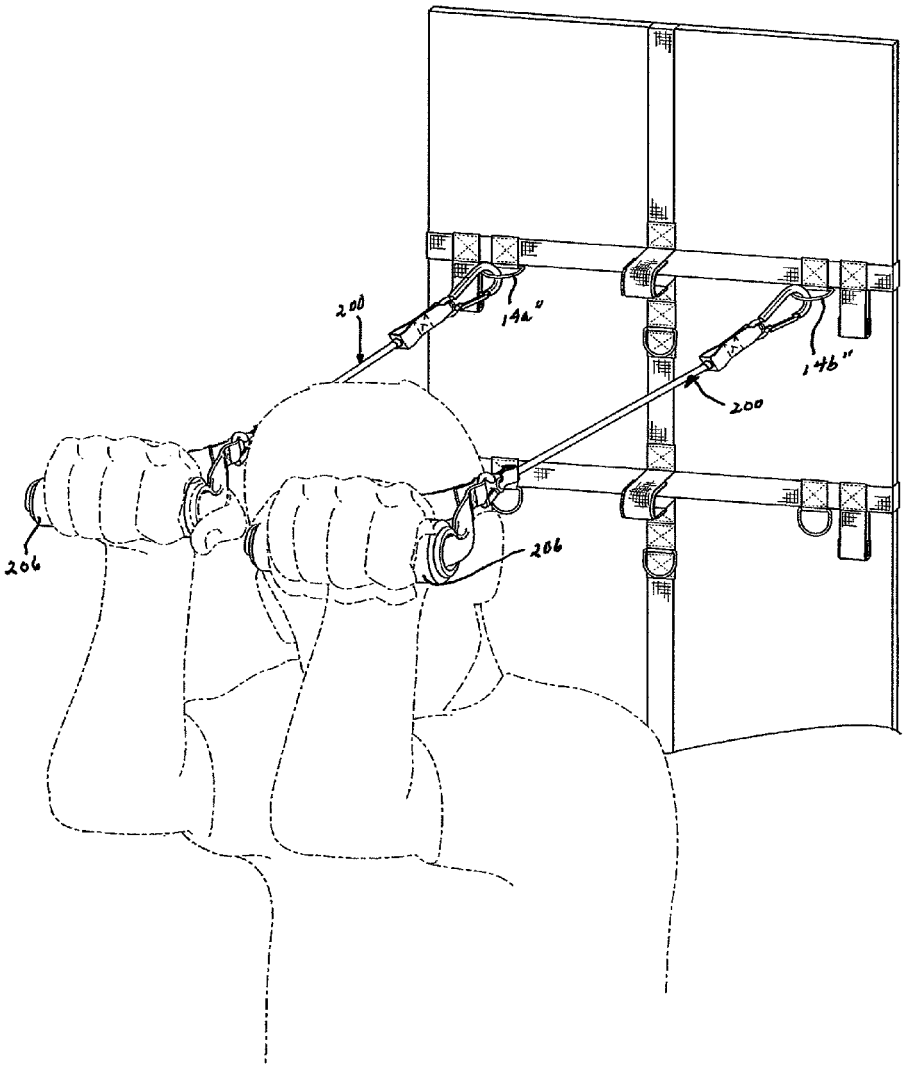

Referring to FIG. 10, exercise bands 200 are shown as being attached to transversely spaced apart ring members 14*a*", 14*b*" and the handles 206 thereof are gripped by the user to carry out an exercise intended to strengthen the triceps. Specifically, the exercise is carried out by the user maintaining his upper arms and elbows stationary and rotating his/her hands about the elbows against the resistive force provided by the stretched bands.

Of course, it should be understood that the exercise bands 200 could be attached to transversely spaced apart ring members on any of the other horizontal strap members 16, 18 and 20 to carry out a wide variety of different exercises.

Figure 11:
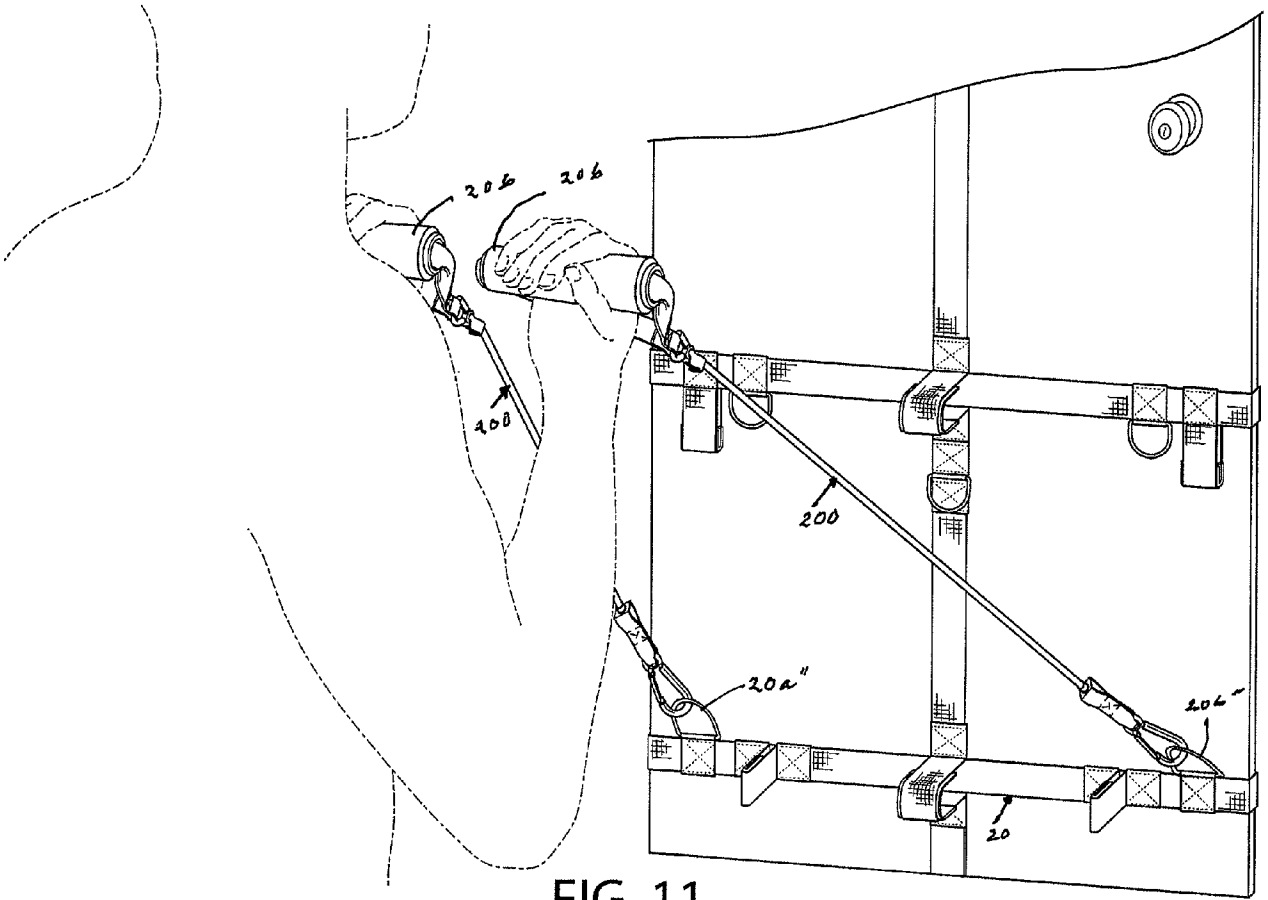

For example, referring to FIG. 11, exercise bands 200 are attached through corresponding carabineers to the upwardly directed, transversely spaced apart ring members 20*a*", 20*b*" of the lower horizontal strap member 20, and the handles 206 are gripped by a user to carry out a bicep, curling exercise.

Figure 12:
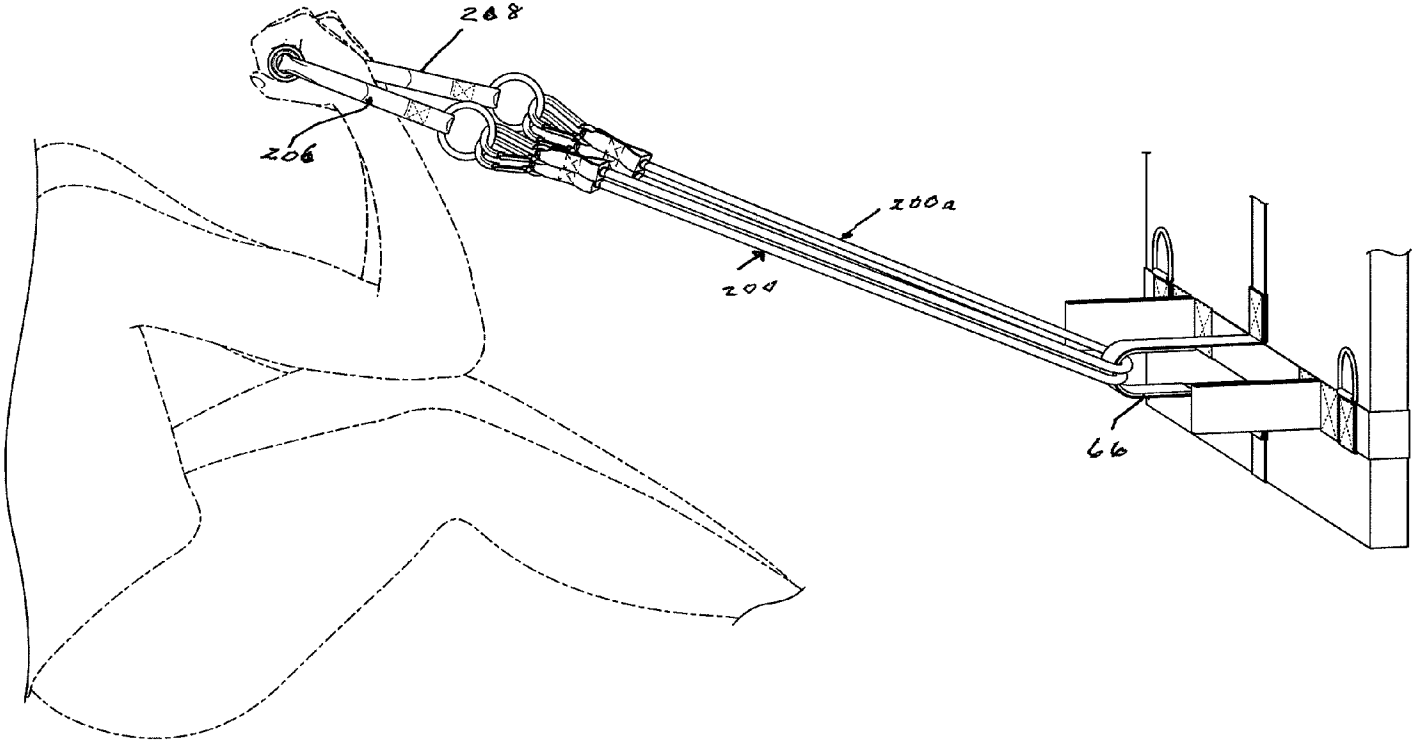

Referring to FIG. 12, a pair of exercise bands 200, 200*a* is extended through loop member 66 and two carabineers at each end of the pair of exercise bands are attached to a respective handle 206, 208. The carabineers can be attached at the remote ends of the elastic bands through a tether connection of the type disclosed in the earlier-identified Kassel '787 patent, which has been incorporated by reference herein. An individual can then carry out an exercise, such as a curl, by sitting on the floor with his/her feet against the door and pulling the elastic band toward his or her body against the resistive force provided by the pair of stretched exercise band 200, 200*a*.

It should be understood that numerous additional exercises can be carried out with the use of one or more elastic exercise bands and the anchor device 10 of the present invention, the number of different exercises being generally limited by the imagination and knowledge of an individual engaged in an exercise routine or by an instructor overseeing and directing the exercise routine.

I claim:

1. An anchor device providing multiple attachment locations for elastic exercise bands and being mountable on a vertical support member having a vertical dimension and a transverse dimension; said anchor device including:

a. a vertically oriented strap member including cooperating attachment members adjacent the opposed ends thereof for attaching the vertically oriented strap member about the vertical dimension of said vertical support member, said vertically oriented strap member, when attached to the vertical support member having a front section and a rear section, said rear section including the cooperating attachment members;

b. a plurality of horizontal strap members attached to said front section of said vertically oriented strap member and being spaced vertically along said front section, each of said horizontal strap members including cooperating attachment members adjacent the opposed ends thereof for attaching said horizontal strap members about a transverse dimension of said vertical support member, said horizontal strap members each having a front horizontal strap section and a rear horizontal strap section, said front horizontal strap section including a first end section extending transversely from one side of the front section of the vertically oriented strap member and a second end section extending transversely from a second side of the front section of the vertically oriented strap member;

c. at least two, transversely spaced-apart band-receiving loop members attached to at least one horizontal strap member being adapted to receive an elastic exercise band therethrough, two of said transversely spaced-apart band-receiving loop members on said at least one horizontal strap member being on said first end section and said second end section, respectively, whereby when an elastic exercise band extends through said two spaced-apart band-receiving loop members slack in the band is taken up by the section of the band bridging the two spaced-apart loop members through which said band extends;

d. at least two, transversely spaced-apart ring members attached to at least one horizontal strap member, two of said transversely spaced-apart ring members on said at least one horizontal strap member being on said first end section and said second end section, respectively, each of said ring members being adapted to be individually connected to an end of separate exercise bands, and e. the front section of each of said plurality of horizontal strap members including said at least two, transversely spaced-apart ring members and/or said at least two, transversely spaced-apart band-receiving loop members attached thereto.

2. The anchor device of claim 1, wherein at least two, transversely spaced-apart ring members and at least two transversely spaced-apart loop members are included on each of a plurality of said horizontal strap members.

3. The anchor device of claim 1, wherein at least two, transversely spaced-apart ring members and at least two transversely spaced-apart loop members are included on each of a plurality of said horizontal strap members, one of said at least two, transversely spaced-apart ring and loop members on each of said plurality of horizontal strap members being on said first end section thereof, and another of said at least two, transversely spaced-apart ring and loop members on each of said plurality of horizontal strap member being on said second end section thereof.

4. The anchor device of claim 1, including a central loop member having opposed end segments attached to the vertically oriented strap member in vertically spaced-apart locations straddling a region in which a horizontal strap member including at least two, transversely spaced-apart loop members is attached to the vertically oriented strap member.

5. The anchor device of claim 1, including a plurality of central loop members, each having opposed end segments attached to the vertically oriented strap member in vertically spaced-apart locations straddling a region in which a respective horizontal strap member including at least two, transversely spaced-apart loop members is attached to the vertically oriented strap member.

6. The anchor device of claim 1, wherein said at least two, transversely spaced-apart loop members include an outer, strong, fabric member and an inner member attached to said fabric member and having a lower coefficient of friction than said fabric member to minimize wear of an elastic exercise band outer surface during an exercise in which said elastic band extends through one or more of said at least two, transversely spaced-apart loop members.

7. The anchor device of claim 1, further including vertically spaced-apart ring members attached in vertically spaced-apart relationship to said vertically oriented strap member.

8. The anchor device of claim 1, wherein two, transversely spaced-apart loop members are attached to a horizontal strap member in a four layer, stitched construction, wherein three of said layers are overlying segments of said loop member and a fourth layer is a segment of the horizontal strap member about which the overlying segments of said loop member are positioned.

9. The anchor device of claim 1, wherein at least two, transversely spaced-apart loop members each include an outer fabric member having opposed end segments attached to a strap member of the anchor device in spaced-apart locations on said strap member, each end segment being attached in a four layer, stitched construction; two of said four layers being provided by each of the end segments of the loop members and an overlying segment of the strap member and the other two of said four layers being provided by opposed segments of a folded, attachment fabric folded over an edge of overlying segments of each of the end segments of the loop member with a corresponding segment of the strap member.

10. An anchor device providing multiple attachment locations for elastic exercise bands and being mountable on a vertical support member having a vertical dimension and a transverse dimension; said anchor device including:

a. a vertically oriented strap member including cooperating attachment members adjacent the opposed ends thereof for attaching the strap member about the vertical dimension of said vertical support member, said vertically oriented strap member, when attached to the vertical support member having a front section and a rear section, said rear section including the cooperating attachment members;

b. a horizontal strap member attached to said front section of said vertically oriented strap member, said horizontal strap member including cooperating attachment members adjacent the opposed ends thereof for attaching the horizontal strap member about a transverse dimension of said vertical support member, said horizontally oriented strap member having a front horizontal strap section and a rear horizontal strap section, said front horizontal strap section including a first end section extending transversely from one side of the front section of the vertically oriented strap member and a second end section extending transversely from a second side of the front section of the vertically oriented strap member;

c. at least two, transversely spaced-apart loop members attached to said horizontal strap member being band-receiving loop members adapted to receive an elastic exercise band therethrough, two of said transversely spaced-apart band-receiving loop members being on said first end section and said second end section, respectively, said two of said transversely spaced-apart band-receiving loop members being attached to said horizontal strap member in a four layer, stitched construction, wherein three of said layers are overlying segments of a band-receiving loop member and the fourth layer is a segment of the horizontal strap member about which the overlying segments of the band-receiving loop member are positioned, whereby when an elastic exercise band extends through said spaced-apart band-receiving loop members slack in the band is taken up by the section of the band bridging the loops through which said band extends.

11. An anchor device providing multiple attachment locations for elastic exercise bands and being mountable on a vertical support member having a vertical dimension and a transverse dimension; said anchor device including:

a. a vertically oriented strap member including cooperating attachment members adjacent the opposed ends thereof for attaching the strap member about the vertical dimension of said vertical support member, said vertically oriented strap member, when attached to the vertical support member having a front section and a rear section, said rear section including the cooperating attachment members;

b. a horizontal strap member attached to said front section of said vertically oriented strap member, said horizontal strap member including cooperating attachment members adjacent the opposed ends thereof for attaching said horizontal strap member about a transverse dimension of said vertical support member, said horizontally strap member having a front horizontal strap section and a rear horizontal strap section, said front horizontal strap section including a first end section extending transversely from one side of the front section of the vertically oriented strap member and a second end section extending transversely from a second side of the front section of the vertically oriented strap member;

c. at least two, transversely spaced-apart band-receiving loop members attached to a strap member and being adapted to receive an elastic exercise band therethrough, each of said band-receiving loop members including an outer fabric member having opposed end segments attached to a strap member of the anchor device in spaced-apart locations on said strap member, each end segment being attached in a four layer, stitched construction, two of said four layers being overlying segments of each of the end segments of the loop members with a corresponding segment of the strap member of the anchor device and the other two of said four layers being opposed segments of a folded, attachment fabric folded over an edge of the overlying segments of each of the end segments of the loop member with a corresponding segment of the strap member.

12. The anchor device of claim 1, wherein said plurality of horizontal strap members includes a lowermost horizontal strap member located at a lower end of the front section of the vertically oriented strap member and an upper horizontal strap member spaced vertically upward from said lowermost horizontal strap member, transversely spaced-apart loop members being attached to said upper horizontal strap member and extend vertically downwardly from the upper horizontal strap member to which said loop members are attached; transversely spaced-apart loop members being attached to the lowermost horizontal strap member and extending outwardly from said lowermost horizontal strap member substantially normal to the vertical support member.

13. The anchor device of claim 1, wherein said cooperating attachment means of the vertically oriented strap member and the horizontal strap members are color-coded to provide a visual indication of the attachment means that cooperate with each other.

14. An anchor device providing multiple attachment locations for elastic exercise bands and being mountable on a vertical support member having a vertical dimension and a transverse dimension; said anchor device including:

a. a vertically oriented strap member including cooperating attachment members adjacent the opposed ends thereof for attaching the vertically oriented strap member about the vertical dimension of said vertical support member, said vertically oriented strap member, when attached to the vertical support member having a front section and a rear section, said rear section including the cooperating attachment members;

b. at least one horizontal strap members attached to said front section of said vertically oriented strap member, said at least one horizontal strap members including cooperating attachment members adjacent the opposed ends thereof for attaching said at least horizontal strap members about a transverse dimension of said vertical support member, said at least one horizontal strap member having a front horizontal strap section and a rear horizontal strap section, said front horizontal strap section including a first end section extending transversely from one side of the front section of the vertically oriented strap member and a second end section extending transversely from a second side of the front section of the vertically oriented strap member;

c. at least two, transversely spaced-apart band-receiving loop members attached to at least one horizontal strap member being adapted to receive an elastic exercise band therethrough, two of said transversely spaced-apart band-receiving loop members on said at least one horizontal strap member being on said first end section and said second end section, respectively, whereby when an elastic exercise band extends through said two spaced-apart band-receiving loop members slack in the band is taken up by the section of the band bridging the two spaced-apart loop members through which said band extends, d. at least two, transversely spaced-apart ring members attached to at least one horizontal strap member, two of said transversely spaced-apart ring members on said at least one horizontal strap member being on said first end section and said second end section, respectively, each of said ring members being adapted to be individually connected to an end of separate exercise bands, and e. wherein said at least two, transversely spaced-apart loop members each include an outer, strong, fabric member and an inner member attached to said fabric member and having a lower coefficient of friction than said fabric member, said inner member of each of said transversely spaced-apart loop members having a transverse dimension greater than the transverse dimension of the fabric member and extending transversely beyond outer edges of said fabric member to minimize wear of an elastic exercise band outer surface during an exercise in which said elastic band extends through one or more of said at least two, transversely spaced-apart loop members.

* * * * *